US005249339A

United States Patent [19]

Wilhelm et al.

[11] Patent Number: 5,249,339

[45] Date of Patent: Oct. 5, 1993

[54] APPARATUS FOR DRAWING IN WARP THREADS

[75] Inventors: Hans Wilhelm, Chur; Raymond Schelling, Sargans, both of Switzerland

[73] Assignee: Zellweger Uster AG, Uster, Switzerland

[21] Appl. No.: 741,531

[22] PCT Filed: Dec. 6, 1990

[86] PCT No.: PCT/CH90/00283

§ 371 Date: Oct. 11, 1991

§ 102(e) Date: Oct. 11, 1991

[87] PCT Pub. No.: WO91/10003

PCT Pub. Date: Jul. 11, 1991

[30] Foreign Application Priority Data

Dec. 22, 1989 [CH] Switzerland ..... 4598/89-8

[51] Int. Cl.[5] ..... D03J 1/14

[52] U.S. Cl. ..... 28/204

[58] Field of Search ..... 28/203.1, 204, 205, 28/206, 207, 201, 202, 208

[56] References Cited

U.S. PATENT DOCUMENTS

| | | | |
|---|---|---|---|
| 3,380,133 | 4/1968 | Meierhofer | 28/205 |
| 3,777,339 | 12/1973 | Fleischer et al. | 28/206 |
| 4,014,083 | 3/1977 | Heinz | 28/205 |
| 4,525,906 | 7/1985 | Tovenrath et al. | 28/205 |
| 4,748,568 | 5/1988 | Tobler | 28/204 X |
| 4,894,893 | 1/1990 | Okuda | 28/202 X |
| 5,084,950 | 2/1992 | Okuda | 28/204 X |
| 5,088,523 | 2/1992 | Buchel et al. | 28/205 X |
| 5,111,560 | 5/1992 | Sato | 28/207 X |

FOREIGN PATENT DOCUMENTS

| | | | |
|---|---|---|---|
| 2902729 | 2/1980 | Fed. Rep. of Germany | 28/205 |
| 8901066 | 2/1989 | Japan | 28/205 |

*Primary Examiner*—Clifford D. Crowder
*Assistant Examiner*—Larry D. Worrell, Jr.
*Attorney, Agent, or Firm*—Burns, Doane, Swecker & Mathis

[57] ABSTRACT

The drawing-in machine has a needle-shaped drawing-in member (7) which is driveable in an oscillating manner and comprises a flexible gripper band (16) which carries a clamping gripper (17) and a channel-like guide (18) for the drawing-in member (7).

15 Claims, 6 Drawing Sheets

30
29
28
25

27
22
26
24
25
24

29
23

18
24
20
33

APPARATUS FOR DRAWING IN WARP THREADS

FIELD OF THE INVENTION

The invention relates to an apparatus for drawing in warp threads into harness elements of a weaving machine, having a needle-shaped drawing-in member, driveable in an oscillating manner, for the warp threads.

BACKGROUND

In known apparatuses of this type, the drawing-in member is formed by a so-called drawing-in needle which has a hook-like end, by means of which the warp threads are caught and drawn in. Quite apart from the fact that there is always the risk when a hook-shaped drawing-in needle of this type is used that a thread will slide out of the needle and therefore will not be drawn in or will be drawn in only incompletely, these drawing-in needles are not advantageous from the textile point of view. This is because the warp threads are deflected practically through 180° in the naturally very thin hook-shaped end and slide via their deflection edge during the drawing-in, which means a not inconsiderable stress and possibly also an effect on the thread at its surface.

SUMMARY OF THE INVENTION

An object of this invention is to provide drawing-in apparatus so constructed and operated that the warp threads are drawn in as carefully and reliably as possible.

This object is achieved according to the invention in that the drawing-in member has a clamping gripper.

Since the clamping gripper securely clamps the warp threads and does not merely hook into them, reliable drawing-in of all types of warp threads is ensured. In addition, these warp threads are protected to the greatest extent, since the warp threads are clamped only at one location, but are otherwise not stressed by additional friction.

A preferred embodiment of the drawing-in member is characterized in that the clamping gripper is carried by a flexible gripper band and in that a channel-like guide is provided for the drawing-in member.

With such a drawing-in member and guiding channel, a drawing-in machine may operate at higher speed and with greater reliability. The mass of the drawing-in member may be small and the drawing-in member by be guided exactly. In this way, the drawing-in member is exactly positioned even at high drawing-in frequencies so that incorrect drawing-in is practically prevented.

BRIEF DESCRIPTION OF THE DRAWINGS

The invention is described in greater detail below with reference to an exemplary embodiment and the drawings, in which.

DESCRIPTION OF PREFERRED EMBODIMENT(S)

Figure 1:
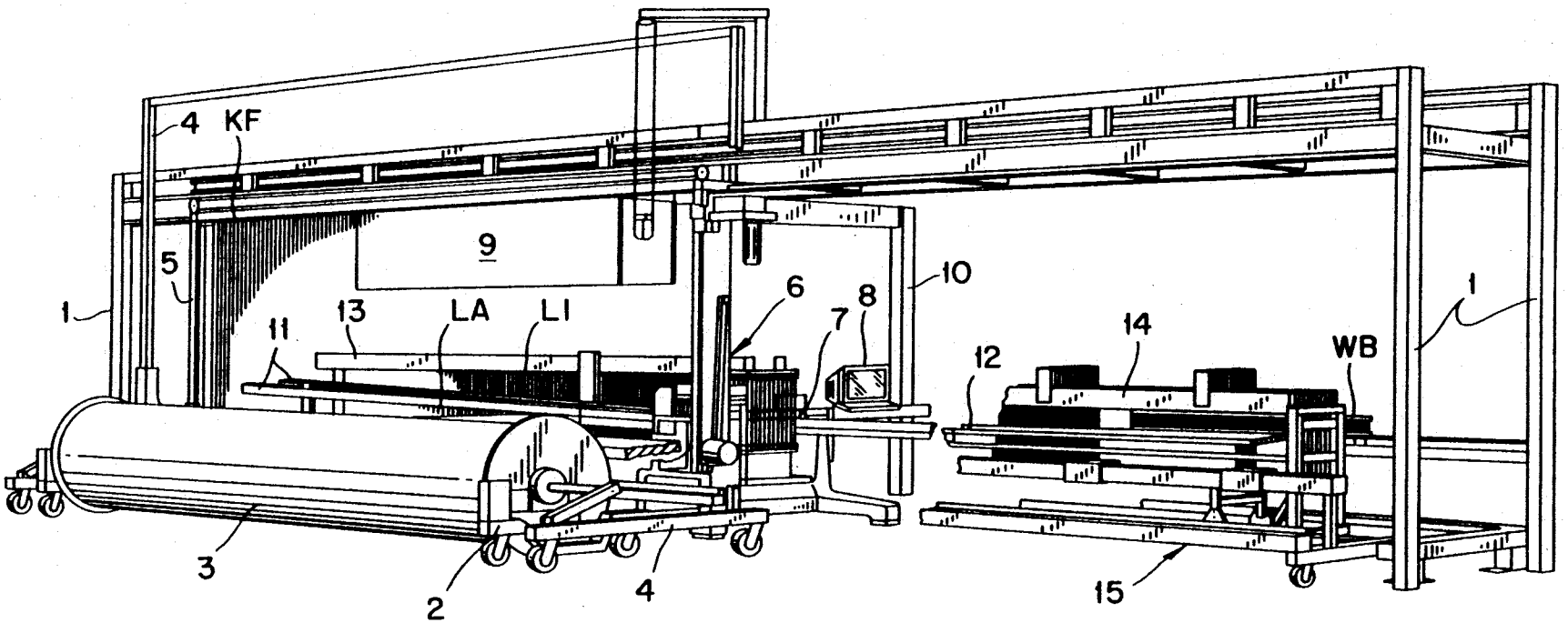
FIG. 1 shows a perspective overall representation of a drawing-in machine according to the invention.

According to FIG. 1, the drawing-in machine according to the invention consists of a mounting stand 1 and various subassemblies arranged in this mounting stand 1, each of which subassemblies represents a functional module. A warp-beam truck 2 with a warp beam 3 arranged thereon can be recognized in front of the mounting stand 1. The warp-beam truck 2 is connected to a so-called lifting device 4 for holding a frame 5, on which the warp threads KF are clamped. This clamping is effected before the actual drawing-in and at a location separate from the drawing-in machine, the frame 5 being positioned at the bottom end of the lifting device 4 directly next to the warp beam 3. For the drawing-in, the warp-beam truck 2 together with warp beam 3 and lifting device 4 is moved to the so-called setting-up side of the drawing-in machine and the frame 5 is lifted upwards by the lifting device 4 and it then assumes the position shown.

The frame 5 and the warp beam 3 are displaced in the longitudinal direction of the mounting stand 1. During this displacement, the warp threads KF are directed past a threadseparating station 6 and as a result are separated and selected. After the selection, the warp threads KF are cut off and presented to a drawing-in needle 7, which forms a component of the so-called drawing-in module. The selecting device used in the warp tying machine USTER TOPMATIC (USTER—registered trademark of Zellweger Uster AG) can be used, for example, for the selection of the warp threads.

Next to the drawing-in needle 7 can be recognized a video display unit 8, which belongs to an operating station and serves to display machine functions and machine malfunctions and to input data. The operating station, which forms part of a so-called programming module, also contains an input stage for the manual input of certain functions, such as, for example, creep motion, start/stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned—drawing-in module, yarn module, control module and programming module, are the heald -, drop-wire -, and reed modules.

The thread-separating station 6, which presents the warp threads KF to be drawn in to the drawing-in needle 7, and the path of movement of the drawing-in needle 7, which runs vertically to the plane of the clamped warp threads KF, define a plane which separates the setting-up side already mentioned from the so-called taking-down side of the drawing-in machine. The warp threads and the individual elements into which the warp threads are to be drawn in are fed at the setting-up side, and the so-called harness (healds, drop wires and reed) together with the drawn-in warp threads can be removed at the taking-down side.

When all warp threads KF are drawn in and the frame 5 is empty, the latter, together with the warp-beam truck 2, the warp beam 3 and the lifting device 4 is located on the taking-down side.

Arranged directly behind the plane of the warp threads KF are the warp-stop-motion drop wires LA, behind the latter the healds LI and further to the rear the reed. The drop wires LA are stacked in hand magazines and the full hand magazines are hung in sloping feed rails 11, on which they are transported to the right towards the drawing-in needle 7. At this location they are separated and moved into the drawing-in position. Once drawing-in is complete, the drop wires LA pass onto drop-wire supporting rails 12 on the taking-down side.

The healds LI are lined up on rails 13 and shifted manually or automatically on the latter to a separating station. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed tooth being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12, fixed thereon, heald shafts 14 and holder for the reed, is pushed into the mounting stand 1 into the position shown and, after the drawing-in, carries the harness having the drawn-in warp threads KF. At this moment, the warp-beam truck 2 together with the warp beam 3 is located directly in front of the harness truck 15. By means of the lifting device 4, the harness is now reloaded from the harness truck 15 into the warp-beam truck 2, which then carries the warp beam 3 and the drawn-in harness and can be moved to the relevant weaving machine or into an intermediate store.

Figure 2:
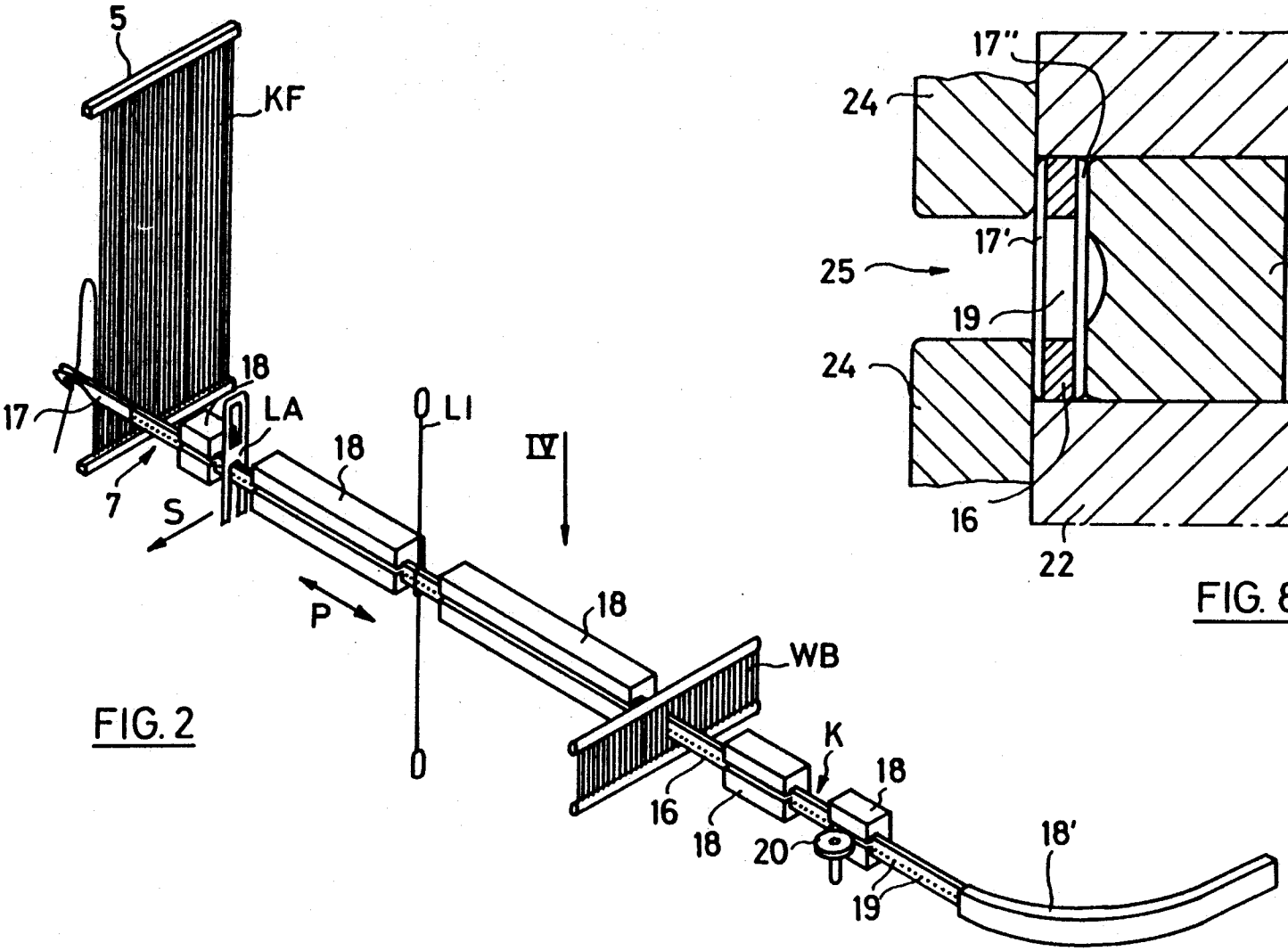
FIG. 2 shows a perspective representation of the drawing-in module of the drawing-in machine of FIG. 1.

As apparent from FIG. 2, the drawing-in needle 7 forming the main component of the drawing-in module is formed by a gripper band 16 and a clamping gripper 17 carried by the same, which are guided in the direction of stroke (arrow P) in a channel-like guide 18. The latter extends from the frame 5 in a rectilinear direction up to a curved end part 18' and is in each case interrupted in the area of the harness elements (drop wires LA, healds LI and reed WB). That is, the guide 18 is formed as a plurality of longitudinally spaced apart and aligned segments with gaps between the segments to permit the feed of the harness elements to the drawing-in position and their further transport after drawing-in (arrow S) is complete. The gripper band 16 is provided with feed holes 19 at a uniform distance apart and is driven by a motor-driven band wheel 20 which has on its periphery knobshaped projections engaging into the feed holes 19.

Figure 3:
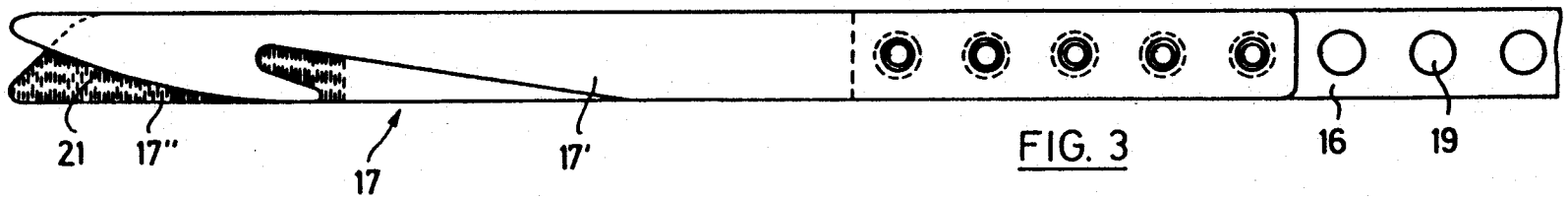
FIG. 3 shows a representation of the drawing-in member.

To an enlarged scale of about 3.5:1, FIG. 3 shows the front end of the gripper band 16 and the clamping gripper 17 fixed thereto, which consists of two parts—a gripper hook 17' and a clamping part 17''. These two parts are designed to be flexible relative to one another, preferably in such a way that, without external action of force, the clamping part 17'' is spread out at its tip away from the gripper hook 17' by about 2.5 mm. The warp thread KF to be drawn in is offered to the clamping gripper 17 in such a way that, when the clamping gripper moves into the thread sheet, the warp thread KF passes into the gap between gripper hook 17' and clamping part 17''. In addition, as indicated in FIG. 2, the warp thread KF is presented to the clamping gripper 17 in an oblique position, and in fact in such a way that the gripper hook 17' open at the bottom presses from above onto the thread when moving into position, so that the latter slides by itself into the jaw of the hook. If the clamping gripper 17 now moves out of the thread sheet, the warp thread is first of all carried along by the gripper hook until the clamping gripper 17 enters the frontmost segment of the guide channel means 18. The gripper hook and clamping part are then pressed together and the warp thread KF is clamped. To increase the clamping action, both parts of the clamping gripper 17 have a toothing 21. At its front part clamping the warp thread, the clamping gripper 17 is thus designed like forceps which are pressed together by the guide 18.

The gripper hook 17' and the clamping part 17'' are made of metal, and the gripper band 16 is preferably a carbon-fibre band. In its end area on the right in FIG. 3, the gripper hook 17' is longer than the clamping part 17'' and, its part over-lapping the clamping part 17'', has cylindrical projections whose spacing corresponds to that of the feed holes 19 and whose diameter has a slight oversize relative to the feed holes 19. The gripper band 16 is pressed with its feed holes 19 onto these projections, as a result of which the connection between clamping gripper 17 and gripper band is made. This connection is detachable and has the advantage that the clamping gripper 17 can be reused if the gripper band 16 breaks. The two parts of the clamping gripper 17 are connected to one another by spot welding. Thus a sandwich type of construction results. The gripper band 16 is thinner that the clamping gripper 17 and thus has lateral clearance in the guide channel 18 even when gripper hook and clamping part are pressed together by the guide channel (see also FIG. 8).

Figure 8:
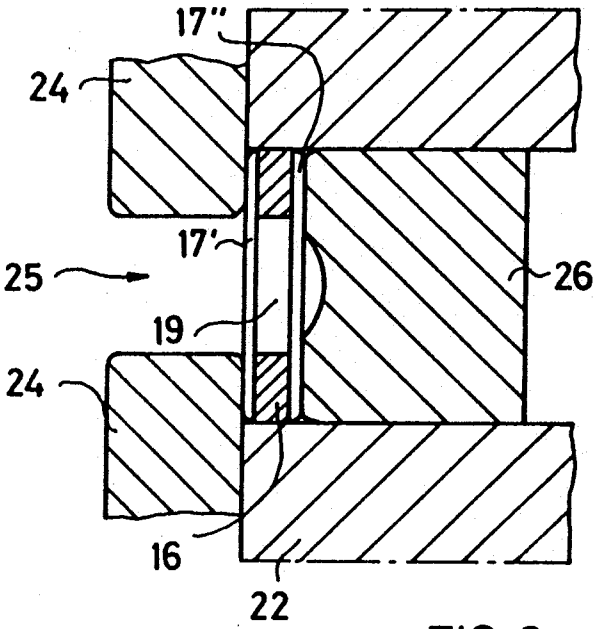
FIG. 8 shows a detail from FIG. *7c* to an enlarged scale.
Figure 4:
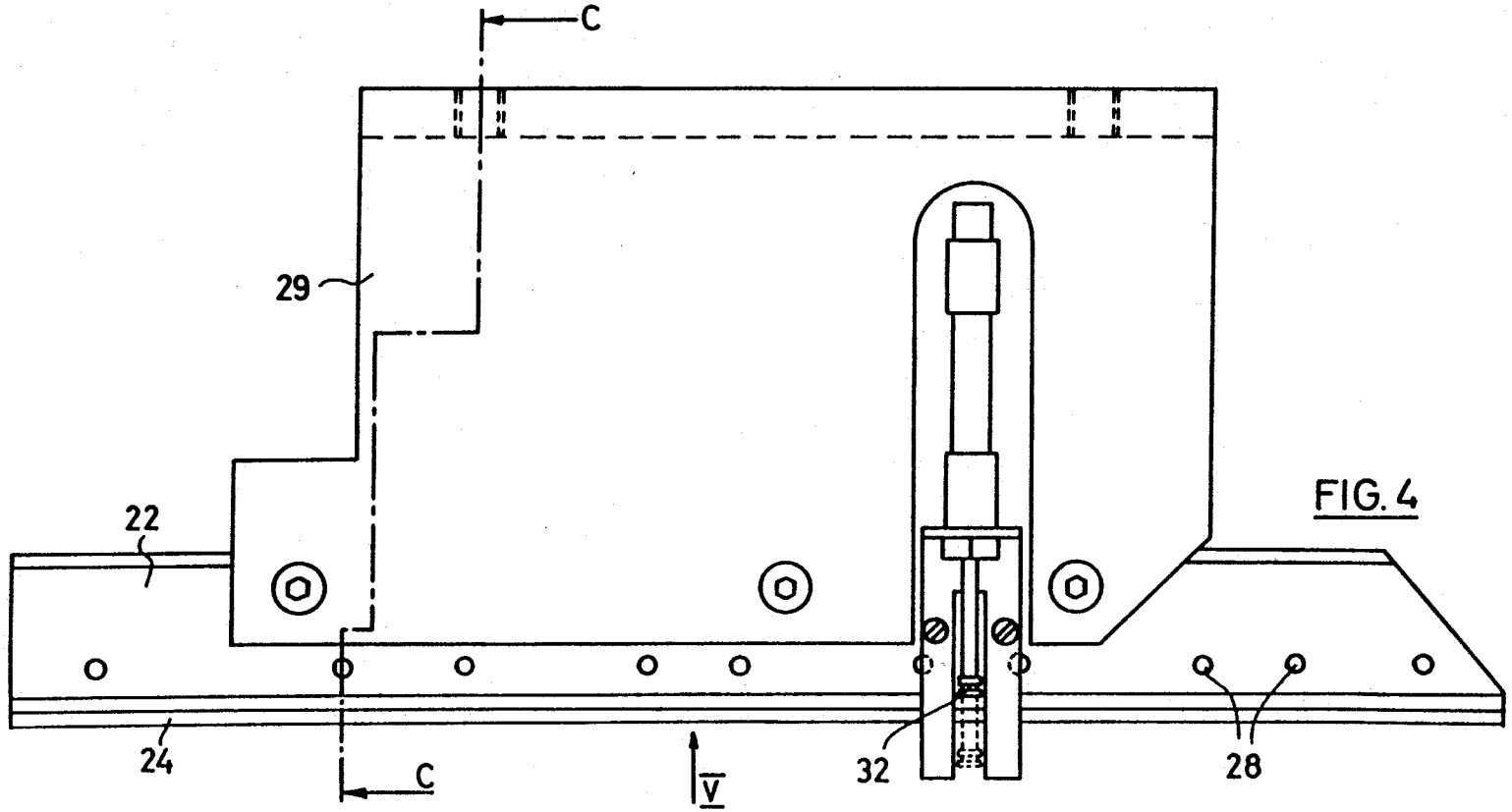
FIG. 4 shows a view in the direction of arrow IV in FIG. 2.
Figure 5:
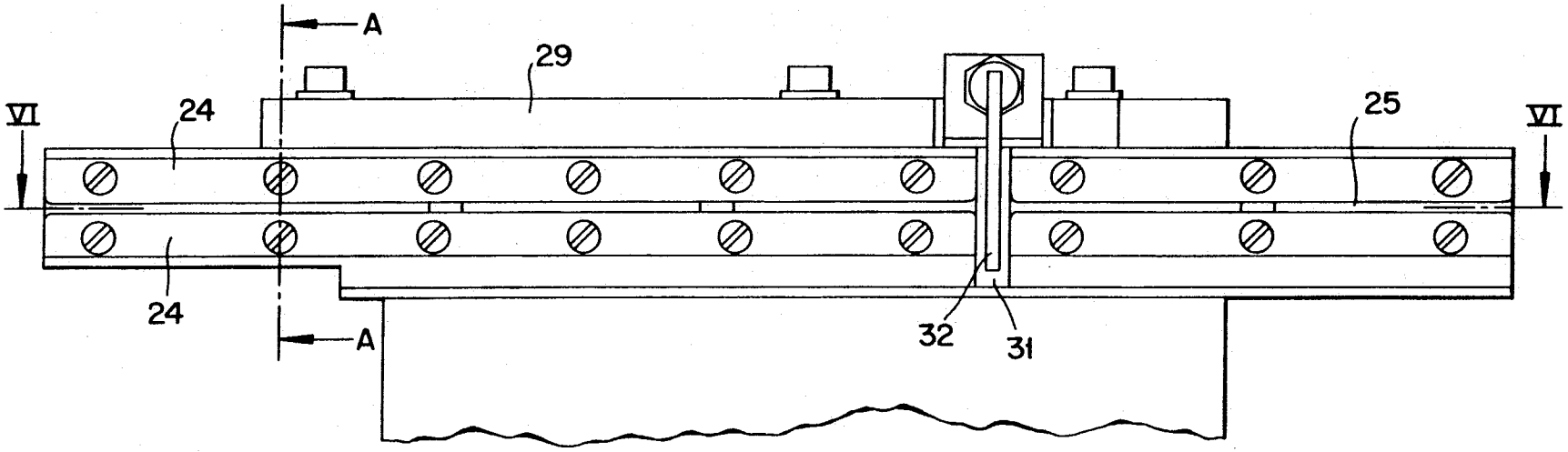
FIG. 5 shows a view in the direction of arrow V in FIG. 4.
Figure 6:
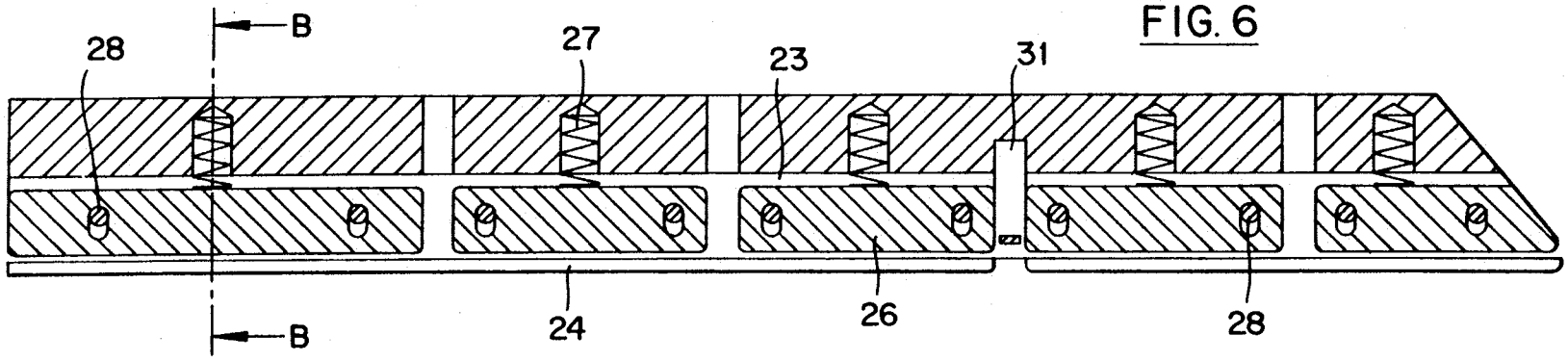
FIG. 6 shows a section along line VI—VI in FIG. 5, FIGS. *7a–7c* show various cross-sections through the guide channel, shown in FIGS. 4 to 6, for the drawing-in member.

The design of the guide channel 18 is apparent from FIG. 4 to 8. FIGS. 4 and 5 show a plan view and a front view respectively of the guide channel; FIG. 6 shows a longitudinal section; FIGS. *7a* to *7c* show cross-sections along lines A—A (FIG. 5), B—B (FIG. 6) and respectively C—C (FIG. 4, all to a scale of 1:1; and FIG. 8 shows an enlarged detail from FIG. *7c* to a scale of 10:1.

According to the representation, the guide channel 18 essentially consists of a profiled bar 22 of aluminium or a suitable plastic, such as, for example, polymethylene oxide, which has a guide groove 23. At its open side, this guide groove 23 is covered at its margins by two elongated cover rails 24 between which there is a slot 25 for the lateral exit of a warp thread drawn into the guide channel 18. Arranged in the root of the guide groove 23 are clamping jaws 26 which are pressed by springs 27 against the cover rails 24. Passing through the clamping jaws 26 are stop and guide pins 28 which ensure that there is a gap of such a width between the cover rails 24 and the clamping jaws 26 that the gripper hook 17' and clamping part 17'' are pressed together just sufficiently. The profiled bar 22 is screwed via suitable supports 29 onto a mounting block 30 indicated by chain lines in FIG. 7*c*.

Figure 10:
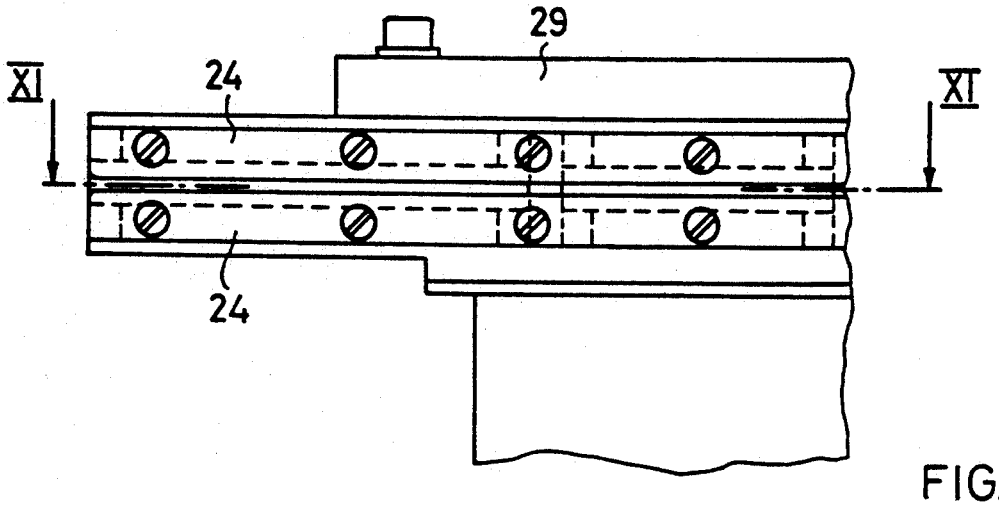
FIG. 10 shows a variant of FIG. 5.
Figure 11:
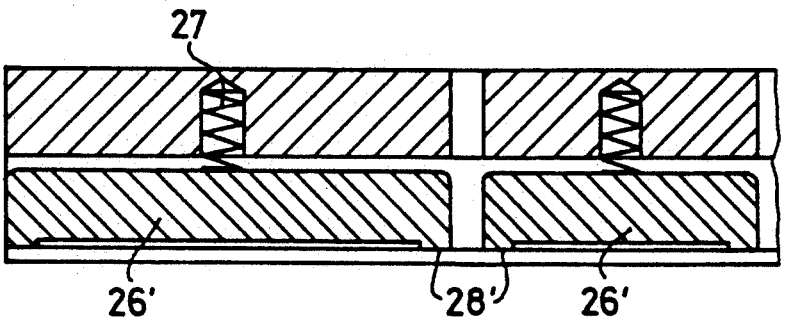
FIG. 11 shows a section along line XI—XI in FIG. 10.

In the variant shown in FIGS. 10 and 11, the stop and guide pins 28 are dispensed with and clamping jaws 26' are used. These clamping jaws 26' have stops 28' contacting the cover rails 24.

In order to ensure that the thread leaves the guide channel 18 through the slot 25 after every drawing-in, the guide channel 18 has a plurality of interruptions 31 in which one thread ejector lever 32 each is arranged. As apparent from FIGS. 4 and 5, these ejector levers 32 can be formed by fingers which are fixed to a pneumatically driveable piston. The levers 32 project downwards from the piston. In their inoperative position drawn in solid lines in FIG. 4, the levers 32 lie behind the plane of the gripper band 16. They are displaced into the position shown by dash lines for ejecting the thread in the direction of arrow S (FIG. 2). The drop wires LA, the healds LI and the reed WB, together with the thread to be removed from the guide channel 18, are likewise transported in the direction of arrow S after drawing-in is complete. Hence, the ejection of the thread is assisted by the harness elements.

Instead of the pneumatically driven thread ejector levers 32 movable in a reciprocating manner, rotating thread ejectors can also be used. In this case, the thread ejectors are designed like an impeller and consist of fingers projecting radially from a hub. The hub is mounted on a mounting block fixed to the profiled bar 22 and can be driven by a motor, the fingers plunging from above into the interruption 31, rotating further forward in the direction of the slot 25 and moving the thread out of the guide channel 18. In order to ensure that, after the thread ejection, the guide channel 18 is free for the next drawing-in and a finger of a thread ejector does not, for instance, protrude into the guide channel, the individual thread ejectors are monitored by light barriers crossing through the plane of movement of the fingers.

Figures 7A, 7B, 7C, 9:
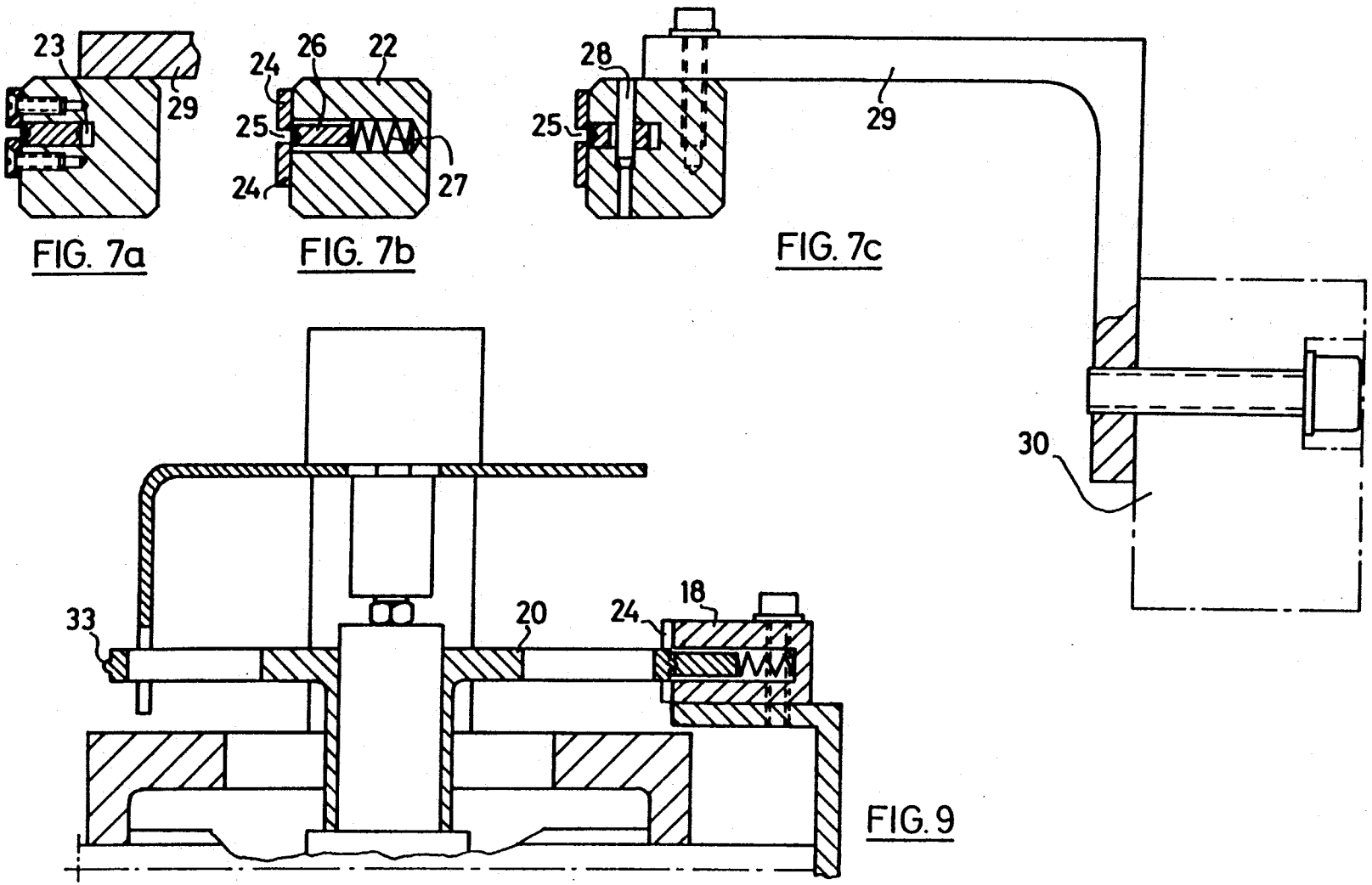
FIG. 9 shows a sectional representation of the drive of the drawing-in member.

FIG. 9 shows a section through the band wheel 20 and the guide-channel part which bears against the band wheel 20 and is not covered here by cover rails 24. The band wheel 20 presses against the front side of the gripper band 16 and its knob-shaped projections 33 are in engagement with the corresponding feed holes 19. The knob-shaped projections 33 are of hemispherical design and have a diameter of 1.5 to 2 mm. preferably 1.8 mm, and a spacing of 4 mm.

In order for the warp thread to actually leave the guide channel 18 after drawing-in is complete, the clamping gripper 17 must first release the thread. This release is effected by controlled opening of gripper hook 17' and clamping part 17'' in the area of the rear holding point of the clamping gripper 17. With regard to FIG. 2, the release takes place in the interruption or gap K between the segment of the guide channel 18 located at the band wheel 20 and the next guide channel segment spaced forwardly therefrom in the direction of the reed WB. The clamping gripper 17 is allowed to open by a part of the guide channel 18 in which the guide gap between cover rails 24 and clamping jaws 26, widens in a funnel shape, so that the clamping part 17'' can spring away from the gripper hook 17'. This widening is preferably in the area of the end, facing the interruption K, of the part of the guide channel 18 arranged between band wheel and reed.

After the clamping action has been released, the thread is drawn by the gripper hook 17' through the interruption K until the clamping gripper 17 reaches its rear reversal point upon entering the part of the guide channel 18 at the band wheel 20. Before reaching this reversal point, the thread is submitted by a lever to the suction part of a suction nozzle which catches and holds the thread.

The lever is formed like a pointer and has a hook-shaped end. It is guided between two disks with the shape of a circular shape. The lever is arranged transverse to the guide channel and its hook-shaped end projects during its power stroke with from the disks. The thread in the guide channel 18 is positioned on the circumference of the disks just in front of the pointer-like lever. When the lever moves, it shifts the thread laterally out of the guide channel, and the thread is guided to the suction nozzle along the contour of the disks.

The pointer-like lever is actuated by a cam in such a way that during its idle stroke from the suction nozzle back to the guide channel, its hook-shaped end passes below the contour of the said disks. The hook-shaped end of the lever penetrates the said contour before the next power stroke, and so on. The suction nozzle has its suction port inclined at an angle of preferably 45° to the axis of the guide channel to optimize the catching of the submitted thread. In practice, it is preferred that the suction nozzle be of the type used in the yarn testing installations sold by Zellweger Uster AG under the trademarks USTER TENSORAPID and USTER TESTER.

Figure 12:
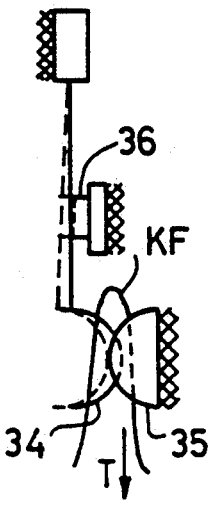
FIG. 12 shows a detail of FIG. 2.

FIG. 12 shows a detail associated with the taking over of a warp thread KF by the clamping gripper 17 (FIG. 2). According to the representation, a sensor is arranged in the plane of movement of the loop-shaped warp thread KF. This sensor checks during each drawing-in cycle whether a warp thread has really been drawn in. This sensor consists of a flexible sensor stirrup 34 which overlaps a fixed counterpart 35. When the thread loop is drawn through by the clamping gripper 17 (arrow T), the sensor stirrup 34 is swung away from the counterpart 35 into the position drawn in a dash line. This movement is detected by a suitable sensor, for example by an inductive sensor 36.

The warp thread to be drawn in is thus always under control, as a result of which maximum reliability and operational safety is ensured. This automatically leads to a further increase in the productivity of the drawing-in machine described, which productivity is also increased by the proposed use of clamping gripper and gripper band. In addition, there is also an exceptionally gentle manipulation of the warp threads.

We claim:

1. Apparatus for drawing-in warp threads into weaving machine harness elements,(LA, LI, WB), comprising oscillatable drawing-in means including a flexible gripper band (16) and a clamping gripper (17) carried by said flexible gripper band, and stationary guide channel means (18) for receiving said oscillatable drawing-in means, said guide channel means (18) including in the area of weaving machine harness elements (LA, LI, WB) a plurality of segments with gaps therebetween and wherein harness elements are movable through said gaps in a direction (S) generally transverse to the length of said guide channel means, said guide channel means comprising means (24, 26) for supporting the clamping gripper (17) and a slot-like opening (25) through which the warp thread being drawn in may extend out of the guide channel means.

2. Apparatus according to claim 1, wherein said guide channel means includes a channel (23) of a cross section to receive said drawing-in means (7) and wherein said guide channel means has elements (26) on one side thereof for pressing flexibly against said clamping gripper (17).

3. Apparatus according to claim 2, wherein said guide channel means includes openings (31) located at intervals along the length of said guide channel means, and wherein said drawing-in apparatus includes thread ejector levers (32) in said openings (31), said thread ejector levers being movable transverse to the channel.

4. Apparatus according to claim 1, wherein said clamping gripper includes thread contacting portions movable between a first relative position in which they are spaced apart to receive a thread therebetween and a second relative position in which they are forced together to clamp a thread between said thread contacting portions, and wherein said guide channel means has a portion at one end for forcing said thread contacting portions of said clamping gripper together and has a portion near its opposite end where a channel for said clamping gripper widens in a funnel-like configuration to allow said thread contacting portions to spread apart.

5. Apparatus according to claim 4, wherein an interruption (K) in the guide channel means (18) is located adjacent to the said funnel-like configuration and wherein said apparatus includes means in the area of the said interruption (K) for picking up the thread released from said clamping gripper.

6. Apparatus according to claim 5, wherein said means for picking up said thread comprises a suction nozzle and an element for delivering the thread to said suction nozzle.

7. Apparatus according to claim 6, including guiding means for the thread between said guide channel means (18) and said suction nozzle.

8. Drawing-in apparatus for threading warp threads sequentially through spaced-apart harness elements for a weaving machine, said drawing-in apparatus comprising a flexible gripper band;

clamping gripper means carried by said gripper band and including a gripper hook and a clamping element, said gripper hook and said clamping element having opposed face portions for receiving a warp thread portion therebetween; and guide channel means for receiving and guiding said flexible gripper band and said clamping gripper means, said guide channel means including longitudinally spaced apart segments aligned with one another so that said band may pass through one of said segments and then through a harness element and then through another of said segments.

9. Drawing-in apparatus according to claim 8, wherein said segments of said guide channel means include a frontmost segment, wherein said clamping gripper means has a thread receiving position in which said clamping gripper means protrudes forwardly from the frontmost one of said segments of said guide channel means, said opposed face portions of said gripper hook and said clamping element being spaced apart from one another in said thread receiving position of said clamping gripper means; wherein said drawing-in apparatus includes a gripper band drive for moving said clamping gripper means rearwardly from said thread receiving position into said frontmost segment of said guide channel means; and wherein said frontmost segment of said guide channel means is shaped to exert pressure on said clamping gripper means during said rearward movement to cause flexing movement of at least one of said gripper hook and said clamping element in a direction to grip a warp thread located between said opposed face portions.

10. Apparatus according to claim 9, including means for connecting together said gripper hook and said clamping element, and wherein said clamping gripper means is detachably mounted to the gripper band.

11. Apparatus according to claim 9, wherein said gripper band includes bores therein, and wherein a rear end portion of one of said gripper hook and said clamping element includes cylindrical projections which fit in ones of said bores in said gripper band.

12. Apparatus according to claim 25, wherein said gripper band includes over the length thereof feed holes at a uniform distance from one another, and wherein said apparatus includes a motor driven wheel for driving said band, said wheel having on the periphery thereof knob-shaped projections for engaging into corresponding ones of said feed holes in said gripper band.

13. Apparatus according to claim 12, wherein said projections are of generally hemispherical shape.

14. Apparatus according to claim 12, including a brushless direct-current motor for driving said wheel.

15. Apparatus according to claim 9, wherein said clamping gripper means is made of metal and said gripper band is made of a carbon-fiber reinforced plastic.

* * * * *